US006009645A

United States Patent [19]

Shimizu et al.

[11] Patent Number: 6,009,645

[45] Date of Patent: Jan. 4, 2000

[54] STEAM IRON WITH SPRAY MIST

[75] Inventors: Masao Shimizu, Nishinomiya; Atsushi Matsuo, Takarazuka; Mamoru Ikeshima, Nishinomiya; Kiichi Shimosaka, Moriguchi; Kenji Kida, Toyonaka; Tomoaki Kajiura, Nagaokakyo, all of Japan

[73] Assignee: Matsushita Electric Industrial Co., Ltd., Osaka, Japan

[21] Appl. No.: 09/088,475

[22] Filed: Jun. 1, 1998

[30] Foreign Application Priority Data

| | | | |
|---|---|---|---|
| Jun. 2, 1997 | [JP] | Japan | 9-143648 |
| Sep. 9, 1997 | [JP] | Japan | 9-243826 |
| Sep. 24, 1997 | [JP] | Japan | 9-258134 |
| Sep. 24, 1997 | [JP] | Japan | 9-258135 |

[51] Int. Cl.[7] ..... D06F 75/22

[52] U.S. Cl. ..... 38/77.5; 38/77.83

[58] Field of Search ..... 38/77.1, 77.3, 38/77.5, 77.83, 77.9; 219/245; 239/61, 75, 407, 410

[56] References Cited

U.S. PATENT DOCUMENTS

| | | | |
|---|---|---|---|
| 2,770,896 | 11/1956 | Holmberg | 38/77.1 |
| 3,001,305 | 9/1961 | Sardeson | 38/77.5 |
| 3,077,900 | 2/1963 | Ehrmann et al. | 38/77.5 X |
| 3,130,507 | 4/1964 | Hoecker | 38/77.5 |
| 3,407,522 | 10/1968 | Jepson et al. | 38/77.83 X |
| 3,691,660 | 9/1972 | Gronwick et al. | 38/77.83 |

FOREIGN PATENT DOCUMENTS

| | | | |
|---|---|---|---|
| 40-17276 | of 0000 | Japan . | |
| 41-16158 | of 0000 | Japan . | |
| 5-200195 | of 0000 | Japan . | |
| 6105996 | 4/1994 | Japan | 38/77.5 |

*Primary Examiner*—Ismael Izaguirre

*Attorney, Agent, or Firm*—Pearne, Gordon, McCoy & Granger LLP

[57] ABSTRACT

A steam iron with spray mist includes a water tank for storing water, a vaporizing chamber for vaporizing water in the water tank so as to generate steam, a base for forming the vaporizing chamber, a heater for heating the base, a base cover for covering an upside of the base, a first passage for guiding water from the water tank into the vaporizing chamber, a mixing chamber in which water in the water tank is formed into fine particles by the action of flow velocity of steam generated in the vaporizing chamber, a second passage for guiding water from the water tank into the mixing chamber, a steam passage for guiding steam from the vaporizing chamber into the mixing chamber, and a spray nozzle for spraying water from the mixing chamber by the action of steam so that the sprayed water can be sent out from an upper portion of the base to the front.

16 Claims, 4 Drawing Sheets

STEAM IRON WITH SPRAY MIST

BACKGROUND OF THE INVENTION

1. Field of the Invention

The present invention relates to a steam iron with spray mist used for ironing the wrinkles out of garments.

2. Description of the Related Art

The following are typical examples of an iron with spray mist by which liquid is sprayed onto fibers to be ironed. The first example is disclosed in Japanese Examined Utility Model Publication No. Sho 40-17276. In this iron with spray mist, water stored in a water tank is sucked up and sprayed by the action of steam generated in a vaporizing chamber. The second example is disclosed in Japanese Examined Patent Publication No. 41-16158. In this iron with spray mist, steam generated in a vaporizing chamber is accumulated in a water tank, so that the pressure of steam is increased. By the action of this increased steam pressure, water is sucked up from the water tank and sprayed. The third example is disclosed in U.S. Pat. No. 3,691,660. In this iron with spray mist, water is sucked up from a water tank by a manual pump unit and sprayed. The fourth example is disclosed in Japanese Unexamined Patent Publication No. Hei 5-200195. In this iron with spray mist, water stored in a water tank is atomized by the action of sound wave energy of an ultrasonic transducer, and the thus atomized water is sprayed.

However, the following problems may be encountered in the above conventional irons with spray mist. When the wrinkles are ironed out of garments, it is common to conduct ironing while steam is being jetted out from the iron for giving an appropriate quantity of water to the garments so that the wrinkles can be easily smoothed out. When it is difficult to smooth out the wrinkles or when ironing is conducted on garments made of cotton or hemp fibers, the wrinkles of which are difficult to be smoothed out, it is common to conduct ironing while water is being sprayed on the garments so as to give a large quantity of water to the garments.

According to the conventional structure described in the first example, although spraying operation is relatively easy, it is difficult to spray water stably under the condition that water is atomized to fine particles. According to the conventional structure described in the second example, it is necessary to increase a pressure in the water tank to a sufficiently high value. Therefore, the structure becomes complicated, and many restrictions are imposed on the manufacture of the irons. According to the conventional structure described in the third example, the structure is simple. Therefore, the irons of the third example have come to wide use. However, the manually operated pump unit tends to fluctuate, and the spray condition of water tends to change, and further it is difficult to use the manually operated pump unit. Concerning the conventional structure described in the fourth example, it is difficult to reduce the size of the iron so that the iron can be handily used.

When the conventional spray units are used, it is difficult to spread water into fibers sufficiently. Therefore, the wrinkles can not be smoothed when ironing is conducted on the fibers. The reason is described as follows. Particles of water in the spray can not be reduced to a size appropriate to penetrate into the fibers. That is, it is impossible to obtain water particles, the size of which is sufficiently fine so that they can penetrate into the fibers.

As a result, in order to give a sufficiently large quantity of water to the fibers, an excessively large quantity of water particles are sprayed on the fibers. Therefore, the fibers get wet beyond what is necessary. Accordingly, in order to remove redundant water, it takes a long time to conduct ironing, and the working efficiency is deteriorated.

Further, the sprayed water spreads widely on the fibers to be ironed, that is, the sprayed water spreads even to a portion where it is unnecessary to conduct ironing. In order to dry the water that has spread in the portion where it is unnecessary to conduct ironing, ironing must be conducted in a large area, and the working efficiency is deteriorated.

The present inventors made experiments and confirmed that a preferable particle size of water is in a range from 20 to 60 $\mu$m so as to penetrate water into natural fibers such as cotton and hemp fibers. When water particles of such a small size are sprayed, it is difficult for an operator to watch the spraying condition. Accordingly, there is a possibility that spraying is conducted beyond what is necessary. As a result, it takes long time to dry the redundant water in the same manner as that described above, and a large quantity of water stored in the water tank is consumed.

Furthermore, it is difficult to clearly see a range in which spraying has already been conducted. Consequently, there is a possibility that an operator forgets to conduct ironing, and the remaining water in the fibers could be a cause of new wrinkles.

SUMMARY OF THE INVENTION

The present invention has been accomplished to solve the above problems, and a first object of the present invention is to make a sufficiently large quantity of water penetrate into fibers to be ironed so as to enhance the effect of ironing and also enhance the working efficiency of ironing.

A second object of the present invention is to enhance the finishing property of natural fibers of high water absorption such as cotton and hemp fibers.

A third object of the present invention is to conduct spraying stably while the particle size of water is maintained at a preferable value.

Other objects of the present invention will be made clear when the examples of the invention are explained.

In order to accomplish the above object of the present invention, water stored in a water tank and steam generated in a vaporizing chamber are introduced into a mixing chamber, and water sent from the water tank is smashed into fine particles by the action of steam of a high flow velocity, and water particles and steam are atomized and sent to the front of a base from the mixing chamber via a spray nozzle. Due to the foregoing, water can be smashed into fine particles and atomized, so that it can be effectively made to penetrate into the fibers. Therefore, the wrinkles of natural fibers such as cotton and hemp fibers can be effectively smoothed, and the working efficiency of ironing can be enhanced.

In order to accomplish the second object of the present invention, the water tank is provided with a pump unit, and water is supplied from the water tank into the vaporizing chamber by this pump unit. Due to the above arrangement, a large quantity of water can be sent to the vaporizing chamber at a time. Therefore, pressure in the mixing chamber is suddenly increased. Accordingly, the particle size of water atomized by the spray nozzle can be more reduced, and spray of fine particle size can be stably provided. Therefore, the finishing property of fibers can be enhanced.

In order to accomplish the third object of the present invention, there is provided a thermally operated opening and closing unit for opening and closing a water passage, which supplies water from the water tank into the vaporizing chamber, at a predetermined temperature. Due to the above arrangement, when the vaporizing chamber is heated to a temperature appropriate to vaporize water, the thermally operated opening and closing unit opens the above water passage, so that water can be supplied from the water tank into the vaporizing chamber. Accordingly, when water enters the vaporizing chamber, it is vaporized instantly, and the thus generated steam of high pressure smashes water into fine particles, so that spray can be sent out stably.

DETAILED DESCRIPTION OF THE PREFERRED EMBODIMENTS

Figure 1:
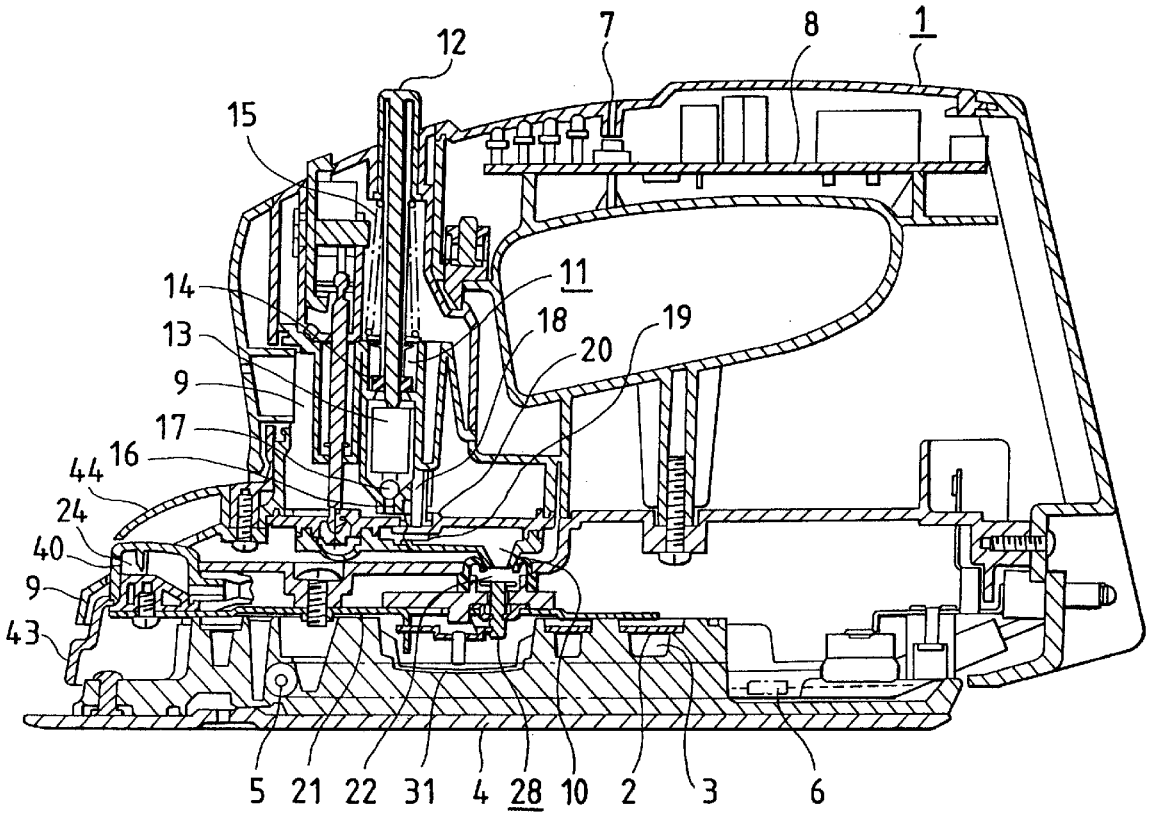
FIG. 1 is a cross-sectional view of a steam iron with spray mist of an example of the present invention.
Figure 2:
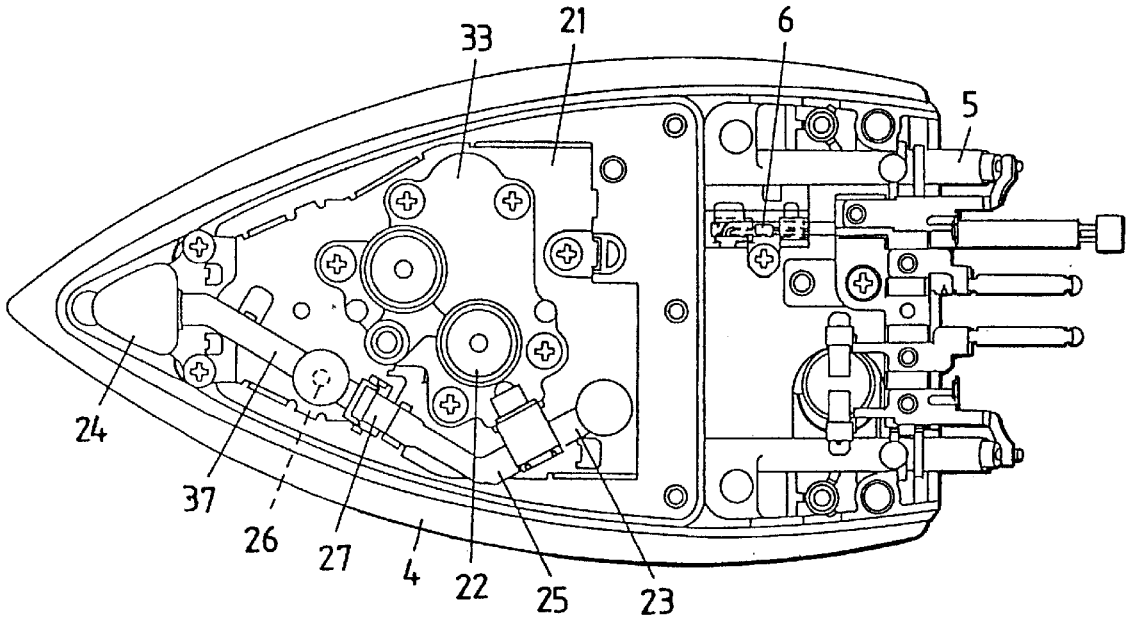
FIG. 2 is a top view of a base of the steam iron with spray mist.
Figure 3:
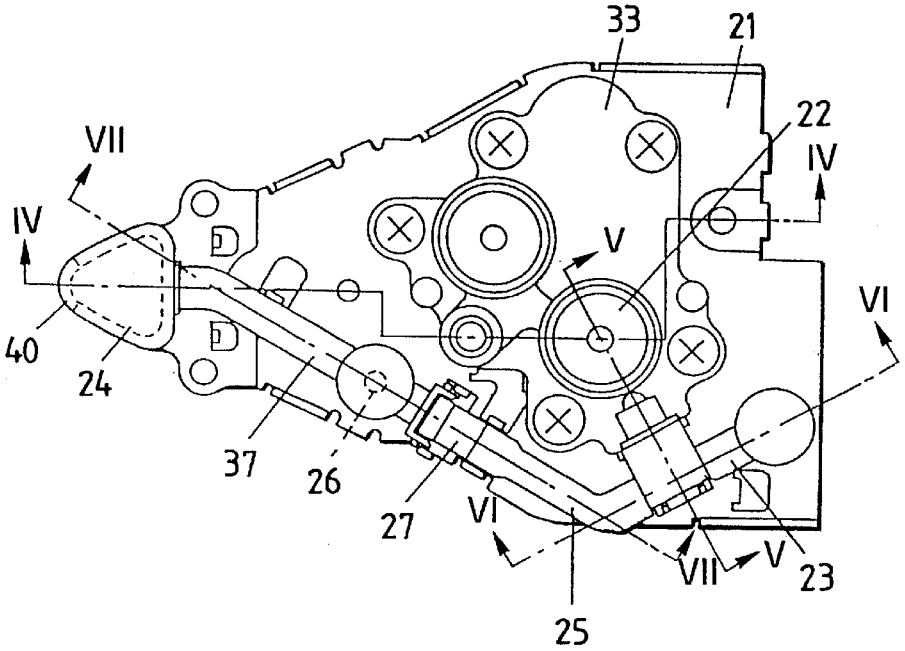
FIG. 3 is a top view of a support of the steam iron with spray mist.
Figure 4:
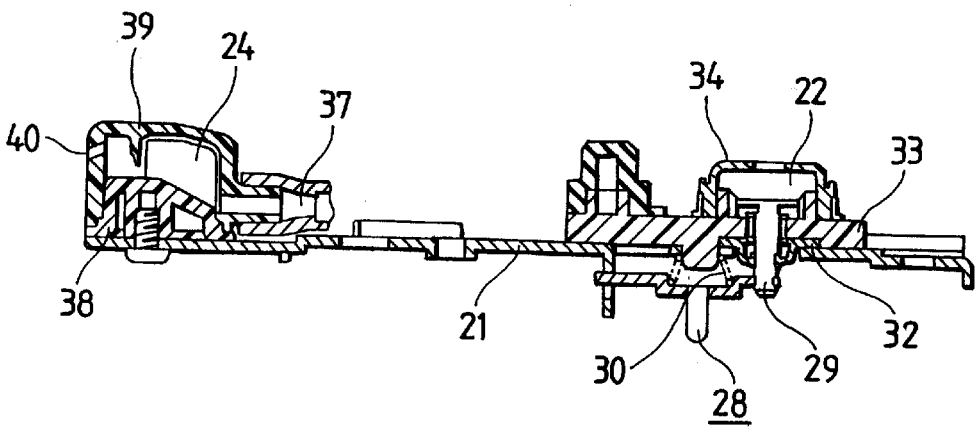
FIG. 4 is a cross-sectional view of the steam iron with spray mist taken on line IV—IV in FIG. 3.
Figure 5:
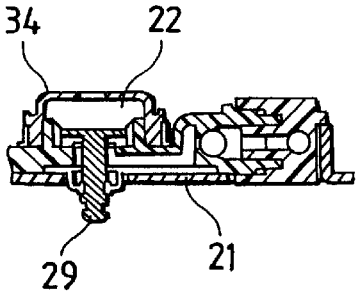
FIG. 5 is a cross-sectional view of the steam iron with spray mist taken on line V—V in FIG. 3.
Figure 6:
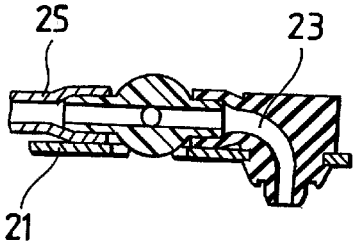
FIG. 6 is a cross-sectional view of the steam iron with spray mist taken on line VI—VI in FIG. 3.
Figure 7:
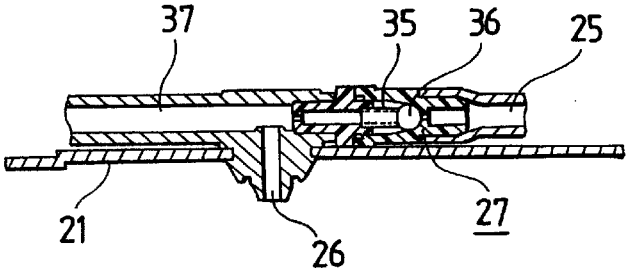
FIG. 7 is a cross-sectional view of the steam iron with spray mist taken on line VII—VII in FIG. 3.
Figure 8:
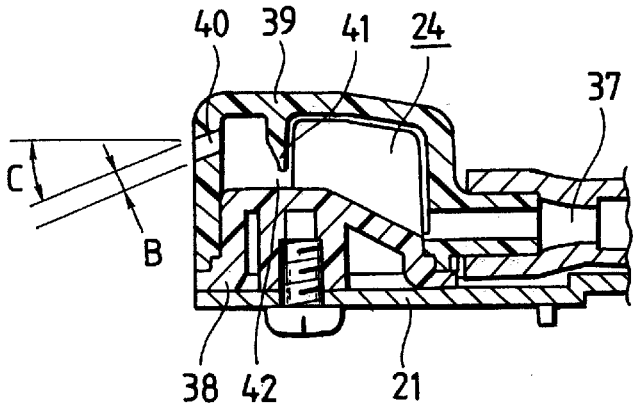
FIG. 8 is a cross-sectional view of a mixing chamber of the steam iron with spray mist.
Figure 9:
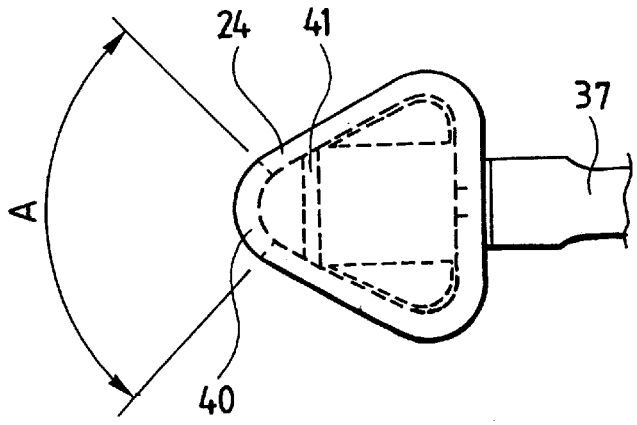
FIG. 9 is a top view of a mixing chamber of the steam iron with spray mist.

According to a first aspect of the present invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; and a spray nozzle for spraying water from the mixing chamber by the action of steam so that the sprayed water can be sent out from an upper portion of the base to the front. Water is smashed into fine particles and sprayed. Therefore, water can be made to penetrate into fibers effectively. Accordingly, the wrinkles of natural fibers such as cotton and hemp fibers can be effectively smoothed, and the working efficiency of ironing can be enhanced.

According to a second aspect of the invention, there is provided a steam iron with spray mist according to the first aspect of the invention, wherein the water tank is provided with a pump unit, and water is supplied from the water tank into the vaporizing chamber by the pump unit. According to the invention, it is possible to supply a large quantity of water to the vaporizing chamber at a time. Therefore, pressure in the mixing chamber is quickly increased, and the size of water particles atomized by the spray nozzle can be further reduced, and spray of fine particles can be stably stabilized and the finishing property of fibers can be enhanced.

According to a third aspect of the invention, there is provided a steam iron with spray mist according to the first aspect of the invention, the second passage for guiding water from the water tank into the mixing chamber is provided with a first valve unit capable of being opened to the mixing chamber side at a predetermined pressure. When the pressure in the vaporizing chamber is increased to a predetermined value, the valve unit is opened and water is supplied to the mixing chamber through the second passage. Accordingly, it is possible to stabilize a ratio of the quantity of water to the quantity of steam supplied to the mixing chamber. Therefore, a quantity of spray sent out from the spray nozzle can be stabilized, and further a spreading angle of the spray can be stabilized, and furthermore the size of water particles can be stabilized.

According to a fourth aspect of the invention, there is provided a steam iron with spray mist according to the first aspect of the invention, wherein the second passage provided between the mixing chamber and the first valve unit is connected with the downstream side of the steam passage so that steam, which has passed through the steam passage, and water, which has passed through the first valve unit, are joined to each other and sent into the mixing chamber. Therefore, it is possible to supply a mixture of steam and water into the mixing chamber. Accordingly, water particles can be made finer in the mixing chamber.

According to a fifth aspect of the invention, there is provided a steam iron with spray mist according to the first aspect of the invention, a support is arranged on the base, and the first passage, second passage and mixing chamber are incorporated into this support. Heights of the first passage, the second passage and the mixing chamber can be stabilized and they are prevented from being inclined. Accordingly, spray can be sent out from the spray nozzle in a good condition.

According to a sixth aspect of the invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; and a spray nozzle for spraying water from the mixing chamber by the action of steam so that the sprayed water can be sent out from an upper portion of the base to the front, wherein the mixing chamber is formed in such a manner that the passage for guiding water and steam into the mixing chamber is expanded like a dome. Accordingly, a flow velocity of steam guided from the steam passage into the mixing chamber can be increased. Therefore, water guided from the water tank into the mixing chamber through the second passage can be smashed to fine particles of uniform size. Therefore, atomization can be accomplished in a good condition.

According to a seventh aspect of the invention, there is provided a steam iron with spray mist according to the sixth aspect of the invention, an upper portion of the mixing chamber is transparent and protruded outside the base cover. Therefore, an increase of temperature in the mixing chamber is suppressed by the outside air. Accordingly, vaporization of water used for atomization which flows into the mixing chamber can be suppressed, and spraying can be conducted in a good condition.

According to an eighth aspect of the invention, there is provided a steam iron with spray mist according to the sixth aspect of the invention, the mixing chamber is longitudinally partitioned by a wall having an opening in the lower portion. Therefore, it is possible to prevent water from jetting out of the spray nozzle before water supplied into the mixing chamber is smashed to fine particles by the action of steam.

According to a ninth aspect of the invention, there is provided a steam iron with spray mist according to the sixth aspect of the invention, wherein the mixing chamber partitioned by a wall is composed in such a manner that a front space in the mixing chamber is smaller than a rear space. Therefore, only fine particles of water made in the mixing chamber can be sprayed from the spray nozzle together with steam.

According to a tenth aspect of the invention, there is provided a steam iron with spray mist according to the sixth aspect of the invention, a bottom surface of the mixing chamber is inclined upward toward an opening formed in a lower portion of the wall. Therefore, an area of the cross-section of the passage in the mixing chamber can be gradually reduced as it comes close to the spray nozzle. Accordingly, water supplied to the mixing chamber can be positively smashed to fine particles by the action of steam.

According to an eleventh aspect of the invention, there is provided a steam iron with spray mist according to the sixth aspect of the invention, wherein an upside of the mixing chamber is covered with a portion of the water tank. Therefore, it is possible to prevent an operator from putting his hand to the mixing chamber, the temperature of which is high.

According to a twelfth aspect of the invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; and a spray nozzle for spraying water from the mixing chamber by the action of steam so that the sprayed water can be sent out from an upper portion of the base to the front, wherein a spray nozzle is provided in the front of the mixing chamber. When water is directly discharged from the mixing chamber into a large space, the pressure of water is reduced at a time at the moment water is jetted out from the spray nozzle. Accordingly, the size of water particles made in the mixing chamber can be further reduced, and they are sprayed to the front portion of the base.

According to a thirteenth aspect of the invention, there is provided a steam iron with spray mist according to the twelfth aspect of the invention, the spray nozzle is formed into a slit-shape extending in the horizontal direction. Accordingly, fine particles of water can be sprayed in an appropriate sector-shaped range of fibers to be ironed.

According to a fourteenth aspect of the invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; a spray nozzle for spraying water from the mixing chamber by the action of steam so that the sprayed water can be sent out from an upper portion of the base to the front; and a thermally operated opening and closing unit capable of opening and closing the first passage in accordance with a temperature of the base. Therefore, when the vaporizing chamber is heated to a temperature appropriate for vaporization of water, the water passage is opened and water is supplied to the vaporizing chamber. Accordingly, immediately after water has been supplied into the vaporizing chamber, it is instantly vaporized, and the size of water particles is reduced by the action of steam of high pressure, and spraying can be conducted in a good condition.

Now, a description will be given in more detail of preferred embodiments of the invention with reference to the accompanying drawings.

As shown in FIGS. 1 to 7, an iron body 1 includes: a base 4 on which a vaporizing chamber 3 covered with a lid 2 is formed; a heater 5 for heating this base 4; a temperature detecting means 6 such as a thermistor for detecting a temperature of the base 4; a temperature setting means 7 for setting a surface temperature of the base 4 to an arbitrary value; a temperature control means 8 composed of a plurality of electronic parts for controlling temperature of the base 4 in accordance with an output of the temperature detecting means 6 and an input of the temperature setting means 7; a detachable water tank 9 for storing water, arranged in an upper portion of the base 4; and a pump unit 11 for supplying water from the water tank 9 to the connecting section 10.

The pump unit 11 includes: an operation button 12 arranged at an upper portion of the water tank 9, the operation button 12 being capable of freely moving in the vertical direction; a piston 14 made of flexible material, sliding in the cylinder 13 in the vertical direction when the operation button 12 is operated; and a button spring 15 urging the operation button 12 upward. The cylinder 13 includes: a water lifting passage 16 which is arranged in a lower portion of the cylinder; a check valve 17 composed of a steel ball for opening and closing the water lifting passage 16; a discharge passage 18 for supplying water from the cylinder 13 to the connecting section 10; a valve body 19 for opening and closing the discharge passage 18; and a packing 20 for sealing the water tank 9 and the discharge passage 18.

There is provided a plate-shaped support 21 made of metal. This plate-shaped support 21 is arranged in an upper portion of the lid 2. The plate-shaped support 21 includes: a water passage 22 connecting with the connecting section 10; a first conduit 23 for guiding water from the water passage 22 into the vaporizing chamber 3; a second conduit 25 for guiding water from the water passage 22 into the mixing chamber 24; a steam passage 26 for guiding steam generated in the vaporizing chamber 3 into the mixing chamber 24; a valve unit 27 for opening and closing the second conduit 25;

a valve unit 29 of the thermally operated opening and closing device 28 for opening and closing the water passage 22; and a valve spring 30.

The thermally operated opening and closing device 28 opens and closes the valve unit 29 by an upward and downward motion of the thermally operated member 31 into which a bimetal is incorporated being curved and also by a resistance force of the valve spring 30. A temperature at which the valve unit 29 is opened is set at about 140° C., and a temperature at which the valve unit 29 is closed is set at about 120° C.

The water passage 22 is composed in such a manner that a packing 32 made of heat-resistant rubber arranged in the support is put on a water passage lid 33. The aforementioned valve unit 29 is incorporated into the water passage 22. The water passage lid 33 is provided with a connection packing 34 for engaging with the connecting section 10 of the water tank 9.

The valve unit 27 is arranged in the downstream of the second conduit 25. In this valve unit 27, the valve body 36 is urged to the upstream side by the valve spring 35. Due to the above arrangement, when a pressure not lower than a predetermined value is given from the upstream side, the valve unit 27 is opened.

The mixing chamber 24 is arranged at a position in the downstream of the mixing passage 37 in which water that has passed through the valve unit 27 and steam sent from the steam passage 26 are joined to each other, and this position is located at a forward end of the support 21. The mixing chamber 24 is composed of a lower member 38 fixed to the support 21 from the lower portion with screws, and an upper member 39 molded from a transparent resin, wherein these two parts are joined to each other by means of ultrasonic welding. The mixing chamber 24 is formed in such a manner that the mixing passage 37 for guiding water and steam to the mixing chamber 24 is expanded upward like a dome.

On the front surface of the upper member 39, there is integrally provided a spray nozzle 40 which is formed into a slit-shape. The shape of the opening portion of the spray nozzle 40 is formed in such a manner that it is extended in the horizontal direction by angle A (about 100°) and that the width in the vertical direction B is approximately 1.5 mm. This nozzle 40 is oblique downward to the front of the iron by angle C (about 15°).

The mixing chamber 24 is divided into a front portion and a rear portion by a wall 41 formed downward from the upper member 39. Between the lower end of this wall 41 and the lower member 38, there is provided an opening 42 through which the front and the rear portion divided by the wall 41 are communicated with each other. A volume of the front space of the mixing chamber 24 divided by the wall 41 is smaller than a volume of the rear space. A bottom portion of the mixing chamber 24 is formed obliquely in such a manner that a portion of the bottom close to the opening 42 formed in a lower portion of the wall 41 is raised higher than a portion of the bottom distant from the opening 42 so that a portion of the bottom on the spray nozzle 40 side can be located at a higher position.

The base cover 43 covers an upside of the base 4. The upper member 39 of the mixing chamber 24 and the spray nozzle 40 penetrate this base cover 43 and protrude outside. Further, the upper member 39 of the mixing chamber 24 and the spray nozzle 40 penetrate a forward end portion of the water tank 9 which extends to the front of the mixing chamber 24, so that the upper member 39 of the mixing chamber 24 comes into contact with the outside air. A transparent cover 44 is attached to the forward end portion of the water tank 9, so that the upside of the mixing chamber 24 is covered with the transparent cover 44.

Operation conducted in the above arrangement will be explained as follows. Water is sprayed on fibers such as cotton and hemp fibers, the wrinkles of which are difficult to be smoothed. Alternatively, water is sprayed on fibers on which a large number of wrinkles are formed. While an appropriate quantity of water is being supplied to the fibers, ironing is conducted. In this case, first, an electric power source is turned on, and the temperature setting means 7 is operated so that a temperature of the base 4 is set at an arbitrary value which is approximately 200° C. which is common for conducting ironing while water is being vaporized. Then the temperature control means 8 outputs a signal in accordance with the output of the temperature detecting means 6. Accordingly, an electric current is made to flow in the heater 5, so that the base 4 is heated to a predetermined temperature. After that, temperature is controlled so that the predetermined temperature can be maintained. When the temperature of the base 4 is increased to the predetermined value, it is possible to start ironing.

At this time, when the temperature of the base 4 is raised to about 140° C., the thermally operated member 31 of the thermally operated opening and closing device 28 detects the heat of the base 4 and conducts an inverting motion, so that the valve spring 30 is compressed and the valve unit 29 is opened. Due to the foregoing, the water passage 22 and the first conduit 23 are communicated with each other. Therefore, water can flow in the passage.

After that, the operation button 12 is pressed while resisting an urging force of the button spring 15, so that the piston 14 can be lowered. Then, when the pressing motion of the operation button 12 is released, the piston 14 is raised upward by the urging force of the button spring 15 while the pressure in the cylinder 13 is made negative.

At this time, the discharge passage 18 is closed by the valve body 19, and at the same time, the check valve 17 is opened, so that water flows from the water tank 9 into the cylinder 13 through the water lifting passage 16. When the operation button 12 is pressed again so as to lower the piston 14, the check valve 17 closes the water lifting passage 16. Therefore, about 1 milliliter of water stored in the cylinder 13 pushes down the valve body 19 and is instantly supplied to the connecting section 10. Since the valve unit 29 is open as described above, water supplied to the connecting section 10 passes through the first conduit 23 from the water passage 22 and is supplied into the vaporizing chamber 3.

In this case, steam which has vaporized in the heated vaporizing chamber 3 flows into the steam passage 26 and is supplied to the mixing passage 37. On the other hand, by the action of steam which has been vaporized in this way, pressure is given to the valve body 36 of the valve unit 27 through the first conduit 23. When the pressure is saturated, the pressure in the mixing chamber 24 is usually the same as the pressure in the second conduit 25. However, since the length of the water passage is different with respect to the water dripping position in the vaporizing chamber, that is, with respect to the steam generating position, the valve body 36 is moved by the pressure instantly given to the second conduit 25 while resisting the spring force of the pressure valve spring 35, so that the valve unit 27 can be opened. As a result, steam flows in the valve unit 27 and is supplied to the mixing passage 37.

Even when water is supplied into the vaporizing chamber 3 and steam is generated, the first conduit 23 is still filled with water. When steam generated in the vaporizing chamber 3 is supplied to the mixing passage 37 through the valve unit 27 as described above, this water in the first conduit 23 is simultaneously sent to the mixing passage 37. The thus sent water is formed into fine particles by the action of flow velocity of steam jetted out from the steam passage 26 and sent into the mixing chamber 24.

After water has collided with the wall 41 in the mixing chamber 24, it is smashed by the action of flow velocity of steam sent from the mixing passage 37, and a swirling current is caused in the rear mixing chamber 24, so that water particles are repeatedly made to be fine. Then, the fine water particles flow in the opening 42 formed in a lower portion of the wall 41 and reach the spray nozzle 40 arranged at the forward end. Accordingly, both steam and water particles exist in the mixing chamber 24 in a pressurized condition. While this two-phase condition of gas and liquid is kept, water particles are jetted out from the slit-shaped spray nozzle 40.

After the pressure of a mixture of steam and water particles has been increased through the opening 42, it is jetted out from the spray nozzle 40 into the atmosphere. At this time, the pressure is reduced at a time. Therefore, the water particles are further smashed to finer particles, that is, the water particles are formed into fine spray. Therefore, fine water particles, the diameter of which is approximately 20 to 60 $\mu$m, are mixed with steam and jetted out to the front of the iron. According to the type of the spray nozzle 40, the horizontal spreading angle of this spray is approximately 100°, and the width of the spray in the vertical direction is approximately 1.5 mm, and the spray is jetted out to the front of the iron obliquely downward by the angle of about 15° with respect to the horizontal line.

Figure 10:
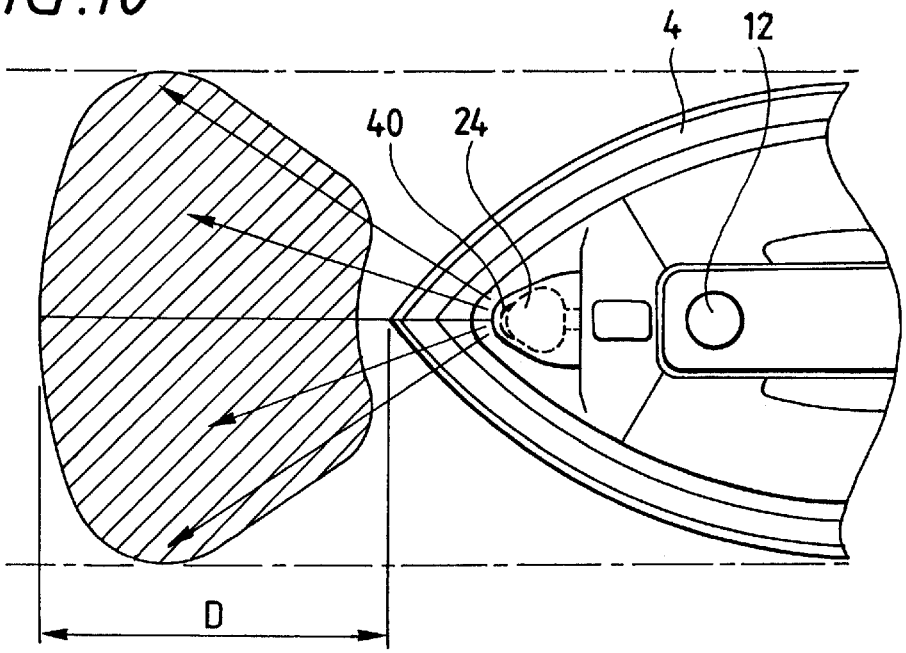
FIG. 10 is a partially cutaway top view showing a range of atomization of the steam iron with spray mist.

As shown by the hatched lines in FIG. 10, the width of a range into which the spray is jetted out is substantially the same as the width of the iron base 4, and the length D of the range from the forward end of the base 4 is approximately 150 mm. Into this sector-shaped range, the spray is jetted out. According to the experiments made by the inventors, when the spray is jetted out into the above sector-shaped range, the efficiency of ironing can be most enhanced, and the iron is most handy.

As described above, when the operation button 12 is repeatedly pressed, ironing can be conducted while spray is being jetted out onto fibers. In this case, when operation of the button 12 is repeatedly conducted, the spraying device is deprived of heat of vaporization. Therefore, the temperature of the base 4 is lowered, and the vaporizing capacity of the vaporizing chamber 3 is deteriorated. In this case, as described before, the valve unit 29 is closed at the temperature of about 120° C. Therefore, an outflow of water from the water passage 22 to the first conduit 23 and the second conduit 25 can be automatically stopped.

Consequently, the water passage 22 is cut off before water sent from the pump unit 11 to the vaporizing chamber 3 can not be perfectly vaporized. Therefore, it is possible to prevent large drips of water, the diameter of which exceeds 1 mm, from being jetted out from the spray nozzle 40. That is, it is possible to conduct spraying of fine particles of water, the spreading angle of which is appropriate, and the finishing property of ironing can be enhanced. Further, there is no possibility that fibers are stained in the process of ironing.

The water passage 22, first conduit 23, second conduit 25, mixing chamber 24 having a spray nozzle 40, steam passage 26, valve unit 27 and thermally operated opening and closing device 28 are arranged in the plate-shaped support 21 arranged at an upper position of the base 4. Therefore, the height of the mixing chamber 24 can be kept constant, and the spraying angle of fine water particles can be stabilized, and the working efficiency can be enhanced. In the same manner, an inclination of the mixing chamber 24 is restricted. Therefore, no water remains in the mixing chamber 24, and it is possible to prevent the remaining water from being jetted out from the spray nozzle 40.

A forward end portion of the base cover 43 protrudes from a forward end portion of the mixing chamber 24. Due to the above arrangement, there is no protrusion at which the garments are hooked in the middle of ironing. Therefore, it is possible to prevent the occurrence of new wrinkles caused when the garments are hooked at a protrusion. In this way, the working property can be enhanced.

As was described above, in the first aspect of the present invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; and a spray nozzle for spraying water from the mixing chamber by the action of steam so that the sprayed water can be sent out from an upper portion of the base to the front. Water is smashed into fine particles and sprayed. Therefore, water can be made to penetrate into fibers effectively. Accordingly, the wrinkles of natural fibers such as cotton and hemp fibers can be effectively smoothed, and the working efficiency of ironing can be enhanced.

In the second aspect of the invention, there is provided a steam iron with spray mist, wherein the water tank is provided with a pump unit, and water is supplied from the water tank into the vaporizing chamber by the pump unit. According to the invention, it is possible to supply a large quantity of water to the vaporizing chamber at a time. Therefore, pressure in the mixing chamber is quickly increased, and the size of water particles atomized by the spray nozzle can be further reduced, and spray of fine particles can be stably stabilized and the finishing property of fibers can be enhanced.

In the third aspect of the invention, there is provided a steam iron with spray mist, wherein the second passage for guiding water from the water tank into the mixing chamber is provided with a first valve unit capable of being opened to the mixing chamber side at a predetermined pressure. When the pressure in the vaporizing chamber is increased to a predetermined value, the valve unit is opened and water is supplied to the mixing chamber through the second passage. Accordingly, it is possible to stabilize a ratio of the quantity of water to the quantity of steam supplied to the mixing chamber. Therefore, a quantity of spray sent out from the spray nozzle can be stabilized, and further a spreading angle of the spray can be stabilized, and furthermore the size of water particles can be stabilized.

In the fourth aspect of the invention, there is provided a steam iron with spray mist, wherein the second passage provided between the mixing chamber and the first valve unit is connected with the downstream side of the steam passage so that steam, which has passed through the steam passage, and water, which has passed through the first valve unit, are joined to each other and sent into the mixing chamber. Therefore, it is possible to supply a mixture of steam and water into the mixing chamber. Accordingly, water particles can be made finer in the mixing chamber.

In the fifth aspect of the invention, there is provided a steam iron with spray mist, wherein a support is arranged on the base, and the first passage, second passage and mixing chamber are incorporated into this support. Heights of the first passage, the second passage and the mixing chamber can be stabilized and they are prevented from being inclined. Accordingly, spray can be sent out from the spray nozzle in a good condition.

In the sixth aspect of the invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; and a spray nozzle for spraying water from the mixing chamber by the action of steam so that the sprayed water can be sent out from an upper portion of the base to the front, wherein the mixing chamber is formed in such a manner that the passage for guiding water and steam into the mixing chamber is expanded like a dome. Accordingly, a flow velocity of steam guided from the steam passage into the mixing chamber can be increased. Therefore, water guided from the water tank into the mixing chamber through the second passage can be smashed to fine particles of uniform size. Therefore, atomization can be accomplished in a good condition.

In the seventh aspect of the invention, there is provided a steam iron with spray mist, wherein an upper portion of the mixing chamber is transparent and protruded outside the base cover. Therefore, an increase of temperature in the mixing chamber is suppressed by the outside air. Accordingly, vaporization of water used for atomization which flows into the mixing chamber can b e suppressed, and spraying can be conducted in a good condition.

In the eighth aspect of the invention, there is to provided a steam iron with spray mist, wherein the mixing chamber is longitudinally partitioned by a wall having an opening in the lower portion. Therefore, it is possible to prevent water from jetting out of the spray nozzle before water supplied into the mixing chamber is smashed to fine particles by the action of steam.

In the ninth aspect of the invention, there is provided a steam iron with spray mist, wherein the mixing chamber partitioned by a wall is compose d in such a manner that a front space in the mixing chamber is smaller than a rear space. Therefore, only fine particles of water made in the mixing chamber can be sprayed from the spray nozzle together with steam.

In the tenth aspect of the invention, there is provided a steam iron with spray mist, wherein a bottom surface of the mixing chamber is inclined upward toward an opening formed in a lower portion of the wall. Therefore, an area of the cross-section of the passage in the mixing chamber can be gradually reduced as it comes close to the spray nozzle. Accordingly, water supplied to the mixing chamber can be positively smashed to fine particles by the action of steam.

In the eleventh aspect of the invention, there is provided a steam iron with spray mist, wherein an upside of the mixing chamber is covered with a portion of the water tank. Therefore, it is possible to prevent an operator from putting his hand to the mixing chamber, the temperature of which is high.

In the twelfth aspect of the invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; and a spray nozzle for spraying water from the mixing chamber by the action of steam so that the sprayed water can be sent out from an upper portion of the base to the front, wherein a spray nozzle is provided in the front of the mixing chamber. When water is directly discharged from the mixing chamber into a large space, the pressure of water is reduced at a time at the moment water is jetted out from the spray nozzle. Accordingly, the size of water particles made in the mixing chamber can be further reduced, and they are sprayed to the front portion of the base.

In the thirteenth aspect of the invention, there is provided a steam iron with spray mist, wherein the spray nozzle is formed into a slit-shape extending in the horizontal direction. Accordingly, fine particles of water can be sprayed in an appropriate sector-shaped range of fibers to be ironed.

In the fourteenth aspect of the invention, there is provided a steam iron with spray mist comprising: a water tank for storing water; a vaporizing chamber for vaporizing water in the water tank so as to generate steam; a base for forming the vaporizing chamber; a heater for heating the base; a base cover for covering an upside of the base; a first passage for guiding water from the water tank into the vaporizing chamber; a mixing chamber in which water in the water tank is formed into fine particles by the action of flow velocity of steam generated in the vaporizing chamber; a second passage for guiding water from the water tank into the mixing chamber; a steam passage for guiding steam from the vaporizing chamber into the mixing chamber; a spray nozzle for spraying water from the mixing chamber by the action of steam so that the sprayed water can be sent out from an upper portion of the base to the front; and a thermally operated opening and closing unit capable of opening and closing the first passage in accordance with a temperature of the base. Therefore, when the vaporizing chamber is heated to a temperature appropriate for vaporization of water, the water passage is opened and water is supplied to the vaporizing chamber. Accordingly, immediately after water has been supplied into the vaporizing chamber, it is instantly vaporized, and the size of water particles is reduced by the action of steam of high pressure, and spraying can be conducted in a good condition.

What is claimed is:

1. A steam iron with spray mist comprising:

a water tank for storing water;

a vaporizing chamber for vaporizing water from the water tank so as to generate steam;

a base for forming the vaporizing chamber;

a heater for heating the base;

a base cover for covering an upside of the base;

a first passage for guiding water from the water tank toward the vaporizing chamber;

a mixing chamber in which water from the water tank is formed into fine particles by action of flow velocity of steam generated in the vaporizing chamber;

a second passage for guiding water from the water tank into the mixing chamber;

a steam passage for guiding steam from the vaporizing chamber toward the mixing chamber; and a spray nozzle for spraying water from the mixing chamber by the action of steam so that is sprayed forwardly out from an upper portion of the base, wherein the second passage is connected with a downstream side of the steam passage so that steam, which has passed through the steam passage, and water in the second passage merge and flow together toward the mixing chamber.

2. A steam iron with spray mist according to claim 1, wherein the water tank is provided with a pump unit, and water is supplied from the water tank to the vaporizing chamber by the pump unit.

3. A steam iron with spray mist according to claim 1, wherein the second passage for guiding water from the water tank toward the mixing chamber is provided with a first valve unit capable of being opened to the mixing chamber at a predetermined pressure.

4. A steam iron with spray mist according to claim 3 wherein the second passage is connected to the downstream side of the steam passage between the mixing chamber and the first valve unit.

5. A steam iron with spray mist according to claim 1, wherein a support is arranged on the base, and the first passage, second passage and mixing chamber are incorporated into said support.

6. A steam iron with spray mist comprising:

a water tank for storing water;

a vaporizing chamber for vaporizing water from the water tank so as to generate steam;

a base for forming the vaporizing chamber;

a heater for heating the base;

a base cover for covering an upside of the base;

a first passage for guiding water from the water tank toward the vaporizing chamber;

a mixing chamber in which water from the water tank is formed into fine particles by the action of flow velocity of steam generated in the vaporizing chamber;

a second passage for guiding water from the water tank toward the mixing chamber;

a steam passage for guiding steam from the vaporizing chamber toward the mixing chamber; and a spray nozzle for spraying water from the mixing chamber by said action of the steam so that water is sprayed forwardly out from an upper portion of the base; and, a mixing passage for guiding water from the second passage and steam from the steam passage into the mixing chamber, said mixing passage being expanded upwardly.

7. A steam iron with spray mist according to claim 6, wherein an upper portion of the mixing chamber is transparent and protrudes from the base cover.

8. A steam iron with spray mist according to claim 6, wherein the mixing chamber is longitudinally partitioned by a wall, said wall having an opening in a lower portion thereof.

9. A steam iron with spray mist according to claim 6, wherein the mixing chamber is partitioned by a wall such that a front space of the mixing chamber is smaller than a rear space of the mixing chamber.

10. A steam iron with spray mist according to claim 9, wherein a bottom surface of the mixing chamber is inclined upward toward an opening formed in a lower portion of the wall.

11. A steam iron with spray mist according to claim 6, wherein an upside of the mixing chamber is covered by a portion of the water tank.

12. A steam iron with spray mist comprising:

a water tank for storing water;

a vaporizing chamber for vaporizing water from the water tank so as to generate steam;

a base for forming the vaporizing chamber;

a heater for heating the base;

a base cover for covering an upside of the base;

a first passage for guiding water from the water tank toward the vaporizing chamber;

a mixing chamber in which water from the water tank is formed into fine particles by action of flow velocity of steam generated in the vaporizing chamber, said mixing chamber being partitioned into a front space and a rear space by a wall;

a second passage for guiding water from the water tank toward the mixing chamber;

a steam passage for guiding steam from the vaporizing chamber toward the mixing chamber; and a spray nozzle for spraying water from the mixing chamber by said action of the steam so that is sprayed forwardly out from an upper portion of the base, wherein said rear space of said mixing chamber receives water from the water tank and steam from said vaporization chamber, and said spray nozzle is provided in the front space of the mixing chamber.

13. A steam iron with spray mist according to claim 12, wherein the spray nozzle is formed into a slit-shape extending in a horizontal direction.

14. A steam iron with spray mist comprising:

a water tank for storing water;

a vaporizing chamber for vaporizing water from the water tank so as to generate steam;

a base for forming the vaporizing chamber;

a heater for heating the base;

a base cover for covering an upside of the base;

a first passage for guiding water from the water tank toward the vaporizing chamber;

a mixing chamber in which water from the water tank is formed into fine particles by action of flow velocity of steam generated in the vaporizing chamber;

a second passage for guiding water from the water tank toward the mixing chamber;

a steam passage for guiding steam from the vaporizing chamber into the mixing chamber;

a spray nozzle for spraying water from the mixing chamber by said action of the steam so that water is sprayed forwardly out from an upper portion of the base; and a thermally operated opening and closing unit capable of opening and closing the first passage in accordance with a temperature of the base.

15. A steam iron with spray mist comprising:

a water tank for storing water;

a vaporizing chamber for vaporizing water from the water tank so as to generate steam;

a pump unit for supplying water from the water tank to the vaporizing chamber;

a base for forming the vaporizing chamber;

a heater for heating the base;

a base cover for covering an upside of the base;

a first passage for guiding water from the water tank toward the vaporizing chamber;

a mixing chamber in which water from the water tank is formed into fine particles by action of flow velocity of steam generated in the vaporizing chamber;

a second passage for guiding water from the water tank the mixing chamber;

a first valve unit for opening the second passage to the mixing chamber at a predetermined pressure;

a steam passage for guiding steam from the vaporizing chamber the mixing chamber; and a spray nozzle for spraying water from the mixing chamber by said action of the steam so that water is sprayed forwardly out from an upper portion of the base.

16. A steam iron with spray mist comprising:

a water tank for storing water;

a vaporizing chamber for vaporizing water from the water tank so as to generate steam;

a pump unit for supplying water from the water tank to the vaporizing chamber;

a base for forming the vaporizing chamber;

a heater for heating the base;

a base cover for covering an upside of the base;

a first passage for guiding water from the water tank toward the vaporizing chamber;

a mixing chamber in which water from the water tank is formed into fine particles by action of flow velocity of steam generated in the vaporizing chamber;

a second passage for guiding water from the water tank toward the mixing chamber;

a first valve unit for opening the second passage to the mixing chamber at a predetermined pressure;

a steam passage for guiding steam from the vaporizing chamber toward the mixing chamber; and a spray nozzle for spraying water from the mixing chamber by said action of the steam so that water is sprayed forwardly out from an upper portion of the base, wherein the mixing chamber is formed such that a mixing passage for guiding water and steam toward the mixing chamber is expanded upwardly.

* * * * *